US005650016A

United States Patent [19]

Jones

[11] Patent Number: 5,650,016

[45] Date of Patent: Jul. 22, 1997

[54] METHOD OF CLEANING A SURFACE

[76] Inventor: Josephine Jones, 4 Surrey Cir., Wichita Falls, Tex. 76309

[21] Appl. No.: 560,460

[22] Filed: Nov. 17, 1995

Related U.S. Application Data

[60] Continuation of Ser. No. 296,722, Aug. 26, 1994, abandoned, which is a division of Ser. No. 109,336, Aug. 19, 1993, abandoned.

[51] Int. Cl.[6] ..... B08B 7/00

[52] U.S. Cl. ..... 134/6; 134/42

[58] Field of Search ..... 134/6, 42; 15/208, 15/209.1, 229.11, 229.12, 229.14, 118, 244.3

[56] References Cited

U.S. PATENT DOCUMENTS 4,338,366 7/1982 Evans et al. ..... 428/76

4,947,504 8/1990 Ostwald ..... 15/119 A 4,993,099 2/1991 Emura et al. ..... 15/118

*Primary Examiner*—Zeinab El-Arini

*Attorney, Agent, or Firm*—John R. Flanagan

[57] ABSTRACT

A method of cleaning a surface includes providing a cleaning pad made of at least one fibrous layer of a detergent-free material, which also leaves a clear, slick, protective coating, surface cleaning method involves soaking the cleaning pad with water, wiping the surface to be cleaned with the water-soaked pad, and wiping the surface dry with a terry cloth towel after the surface has been wiped with the water-soaked pad. Also, the surface is wetted and wiped with the water-soaked pad and then wiped and dried with the terry cloth towel without exposure to direct sunlight.

2 Claims, 1 Drawing Sheet

METHOD OF CLEANING A SURFACE

This application is a continuation of application Ser. No. 08/296,722, filed Aug. 26, 1994, now abandoned, which is a divisional of patent application Ser. No. 08/109,336, filed Aug. 19, 1993, now abandoned.

BACKGROUND OF THE INVENTION

1. Field of the Invention

The present invention generally relates to cleaning devices and techniques and, more particularly, is concerned with a system and a method of cleaning a surface employing the cleaning pad, which at the same time leaves a hard, slick, protective coating.

2. Description of the Prior Art

Every year consumers spent millions of dollars on a wide variety of devices promoted as effective solutions for cleaning various hard shiny surfaces such as glass surfaces of windows, ceramic tile and other articles and also metallic and fiberglass surfaces of vehicle bodies. These cleaning devices typically range from bottles of liquid cleaners to rolls of paper towels. After they are used, most end up in landfills where they contribute to degradation of the environment. Further, some of these products contain ammonia, alcohol or other harmful chemicals.

For a variety of reasons, many people have been and continue to be dissatisfied with the cleaning devices which have been promoted commercially over the years as effective solutions for cleaning the various hard shiny surfaces. One reason for this dissatisfaction is that some of the cleaning devices are difficult for the average person to use effectively. Another reason is the relatively poor job some of the cleaning devices actually do. Still another and more recent reason is the growing concern about the significant contribution these devices make to current waste disposal problems.

About two decades ago, a single-layer pad of a fibrous material, such as polyester fibers, was devised and briefly marketed as a cleaning device by the inventor herein. However, the form and method of use of this earlier, or prior art, cleaning pad failed to achieve the desired results in terms of providing an adequately cleaned surface. This prior cleaning method involved soaking the pad with water and then rubbing or wiping the surface of an article to be cleaned to remove dirt, film and smudges. The method was performed without concern as to whether the article was exposed to direct sunlight or not. The results were sometimes adequate and othertimes inadequate in that the surface quality would be cloudy and streaked. Thus, the aforementioned prior art cleaning device and method devised by the inventor herein gave unpredictable and unsatisfactory results.

Consequently, a need still exists for a new and more effective solution to cleaning the various hard shiny surfaces mentioned above which will avoid the aforementioned drawbacks of prior cleaning devices and methods.

SUMMARY OF THE INVENTION

The present invention provides a system and method for cleaning a surface which solve the problems encountered with prior art cleaning devices including the cleaning pad devised earlier by the inventor herein. The cleaning system and method of the present invention cleans these surfaces without the use of soaps, detergents or other cleaning agents and provides a long-lasting clean slick surface or protective coating of high quality which retards deposit of foreign matter, such as grime and lint, and permits easy removal of such matter once deposited. Also, the cleaning pad and method of the present invention entail much less work on the part of users and much lower cost to employ. Further, the cleaning system and method of the present invention are non-toxic and contribute significantly to alleviation of environmental degradation by permitting repeated use of the pad which substantially reduces the amount of material which is discarded.

Unlike the previous cleaning pad devised by the inventor herein and unlike other prior art cleaning devices, the cleaning pad of the present invention comprises: (a) a plurality of individual layers of a fibrous material in a blanket-like form being disposed one on top of the other in a stacked relationship, the plurality of layers including a pair of outer layers and at least one inner layer disposed between the outer layers; and (b) means attaching the individual layers to one another in the stacked relationship solely about the respective perimeters thereof. The individual inner layer of the cleaning pad has greater loft than each of the individual outer layers thereof.

Unlike the previous surface cleaning method devised by the inventor herein and unlike other prior art cleaning methods, the surface cleaning method of the present invention comprises the steps of: (a) soaking the pad with water; (b) wetting and wiping the surface to be cleaned with the water-soaked pad; and (c) wiping and drying the surface with a terry cloth towel after the surface has been wiped with the water-soaked pad. The surface is wetted and wiped with the water-soaked pad and wiped and dried with the terry cloth towel without exposure to direct sunlight.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
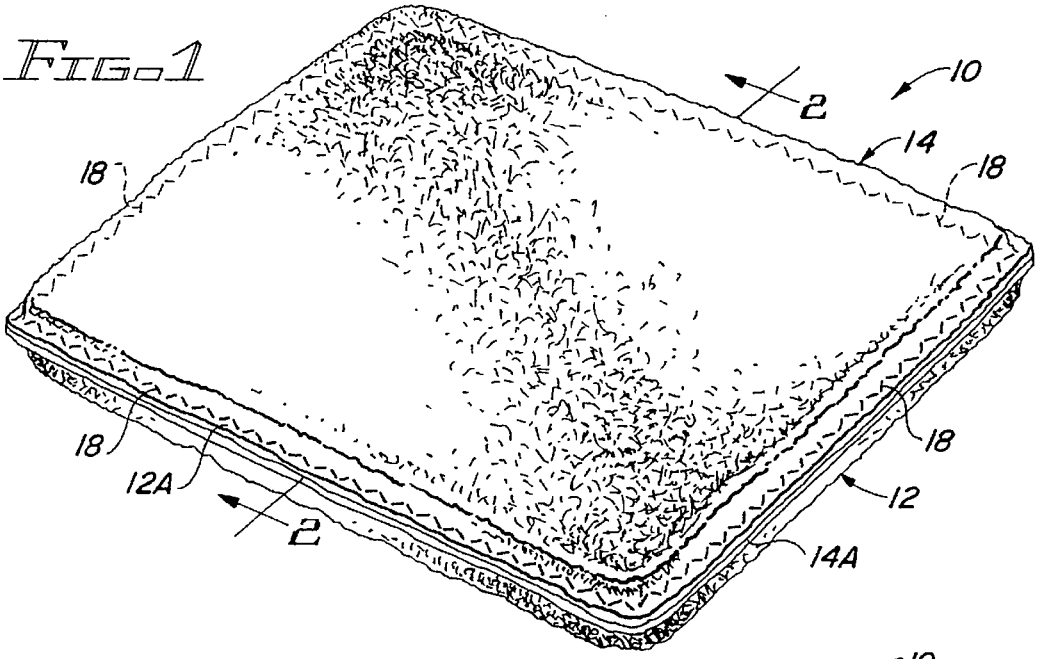
FIG. 1 is a perspective view of the multilayer fibrous cleaning pad in accordance with the present invention.
Figure 2:
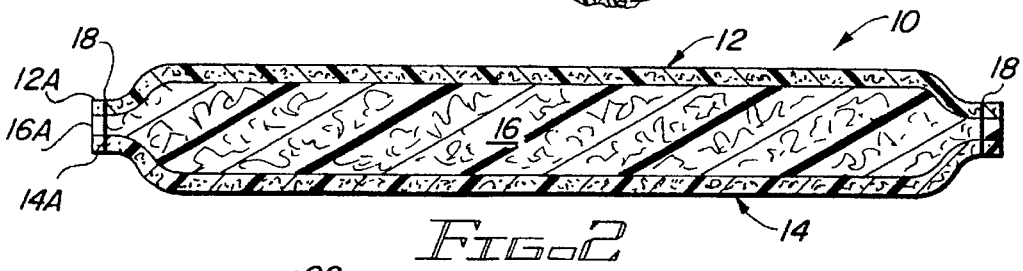
FIG. 2 is a cross-sectional view of the cleaning pad taken along line 2—2 of FIG. 1.
Figure 3:
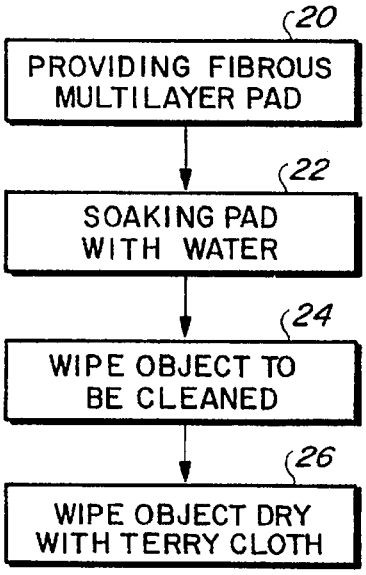
FIG. 3 is an exploded perspective view of the cleaning pad of FIG. 1.

Referring to the drawings and particularly to FIGS. 1 to 3, there is illustrated a multilayer fibrous cleaning pad, generally designated 10, of the present invention. The cleaning pad 10 includes a plurality of individual layers 12, 14, 16 of fibrous material. Each of the layers 12, 14, 16 are preferably in the form of a bed or blanket of small polyester fibers intertwined together. The layers 12, 14, 16 are disposed one on top of the other in a stacked relationship.

The plurality of layers 12, 14, 16 include a pair of outer layers 12, 14 and at least one inner layer 16 disposed between and extending parallel to the outer layers 12, 14. The outer layers 12, 14 and the inner layer 16 of the cleaning pad 10 have substantially the same lengths and widths so that their respective perimeters 12A, 14A, 16A are superimposed one above the next with the layers in the stacked relationship.

The cleaning pad 10 also includes means for attaching the individual layers 12, 14, 16 to one another about the respective perimeters 12A, 14A, 16A thereof so as to retain the layers 12, 14, 16 in the stacked relationship. The attaching means is in the form of a stitching of thread 18 running along a path extending solely along and about respective perimeters 12A, 14A, 16A of the stacked layers of fibrous material. Preferably, the stitching of thread 18 runs along a zig-zag path.

Furthermore, the individual inner layer 16 of the cleaning pad 10 has greater loft than each of the individual outer layers 12, 14 thereof. In other words, the inner layer 16 of fibrous material is thicker and less compressed than the respective individual outer layers 12, 14 thereof. The less density and greater loft of the inner layer 16 provide more space and capacity in the inner layer 16 for retention of water therein until squeezing out of the water during application of the water to the surface in the wetting and wiping of the surface with the pad 10.

Figure 4:
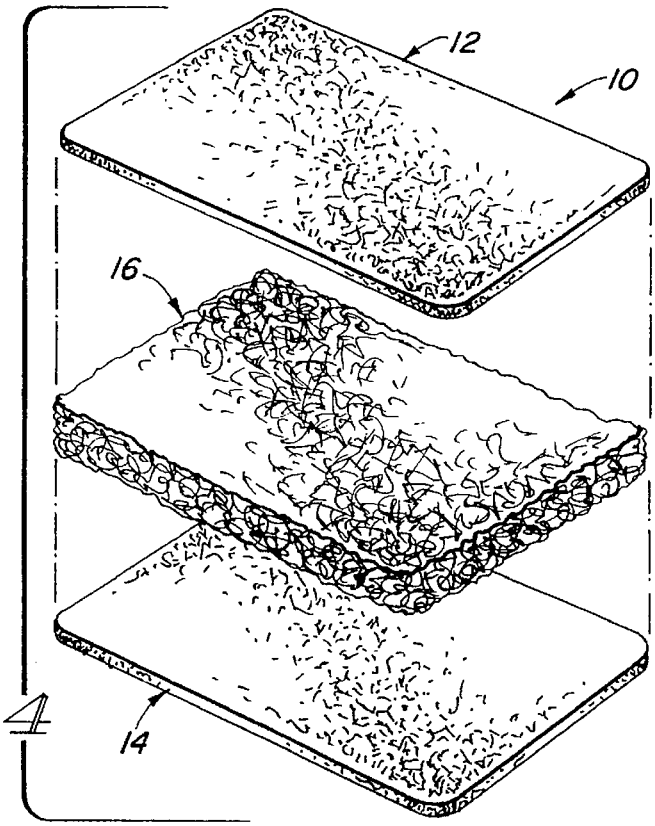
FIG. 4 is a flow diagram of the method steps for cleaning a surface in accordance with the present invention.

Referring to the flow diagram of FIG. 4, there is outlined the particular steps of the method of the present invention for cleaning a surface by employing the cleaning pad 10 of the present invention described above. First, as per block 20, the cleaning pad 10 is provided having the stacked plurality of individual outer low loft layers 12, 14 and inner high layer 16 of fibrous material fabricated in blanket-like form. Next, as per block 22, the cleaning pad 10 is soaked with water. Thirdly, as per block 24, the surface to be cleaned is wetted and wiped using the water-soaked pad 10. Finally, as per block 26, the surface is wiped and dried using a conventional terry cloth towel after the surface has been wiped with the water-soaked pad 10. Furthermore, the surface to be cleaned must be wetted and wiped with the water-soaked pad 10 and wiped and dried with the terry cloth towel without exposure to direct sunlight in order to achieve the desired slick protective coating on glass and other hard articles. It is most surprising that by employing the method described, this pad deposits this coating.

One theory of operation believed to underlie the effectiveness of the cleaning pad 10 and method of the present invention is that the rubbing action of the wetted cleaning pad 10 applies and produces a hard, invisible coating on the surface which, after drying using the terry cloth towel, resists the subsequent attachment of foreign matter to the surface and permits easy removal thereof merely by wiping with a damp cloth. After each reuse of the pad employing the described method, surfaces become successively slicker and more resistant to foreign matter, making it possible to remove smudges and spots by wiping with a dry cloth or tissue; thus, the only reasonable conclusion is that with each reuse of the pad, an additional protective coating is applied.

Also, the drying and polishing of the surface using the conventional terry cloth towel appears to enhance the slick and shiny quality of the surface. Use of other articles, such as paper towels or plain cloths results in streaking and clouding of the surface finish.

Another theory is that substances in the pad, combined with water and the rubbing action, cause a reaction with the surface being cleaned, leaving the coating. Still another theory is that magnetic attraction causes the coating to be deposited. It is not known whether the pad's ability to deposit the coating on these surfaces is due to any one or a combination of two or more of the above-theories, and/or other presently unappreciated characteristics.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A method of cleaning a surface, consisting of the steps of:

(a) providing a cleaning pad having at least one fibrous layer of a detergent-free polyester material;

(b) applying a quantity of detergent-free water to said detergent-free polyester material of said cleaning pad;

(c) wiping a surface to be cleaned, while not exposed to direct sunlight, using the detergent-free polyester material of said cleaning pad ladened with the quantity of detergent-free water so as to wet and wipe clean the surface and cause depositing thereon of a protective slick shiny coating of a material derived from the detergent-free polyester material of said cleaning pad; and (d) drying the clean surface, while not exposed to direct sunlight, without removing the protective slick shiny coating therefrom by wiping said surface using a terry cloth towel, the protective slick shiny coating resisting subsequent attachment of foreign matter to the clean surface thereby permitting subsequent easy removal of foreign matter.

2. A method of cleaning a surface, consisting of the steps of:

(a) providing a cleaning pad having multiple individual fibrous layers of a detergent-free polyester material, said layers being disposed one on top of the other in a stacked relationship and attached to one another about respective perimeters thereof;

(b) applying a quantity of detergent-free water to said detergent-free polyester material of said cleaning pad;

(c) wiping a surface to be cleaned, while not exposed to direct sunlight, using the detergent-free polyester material of said cleaning pad ladened with the quantity of detergent-free water so as to wet and wipe clean the surface and cause depositing thereon of a protective slick shiny coating of a material derived from the detergent-free polyester material of said cleaning pad; and (d) drying the clean surface, while not exposed to direct sunlight, without removing the protective slick shiny coating therefrom by wiping said surface using a terry cloth towel, the protective slick shiny coating resisting subsequent attachment of foreign matter to the clean surface thereby permitting subsequent easy removal of foreign matter.

* * * * *